US006662733B1

(12) United States Patent
Scott

(10) Patent No.: US 6,662,733 B1
(45) Date of Patent: Dec. 16, 2003

(54) MULTI-LEAF ORGANIZER

(76) Inventor: Martin Carl Scott, 1012 Corsaire Cove, Austin, TX (US) 78734

( * ) Notice: Subject to any disclaimer, the term of this patent is extended or adjusted under 35 U.S.C. 154(b) by 133 days.

(21) Appl. No.: 09/982,683

(22) Filed: Oct. 18, 2001

(51) Int. Cl.[7] ..... A47B 23/00
(52) U.S. Cl. ..... 108/43
(58) Field of Search ..... 108/43, 42, 44, 108/25, 59, 65, 67, 69, 77, 35, 36, 50.01, 50.11

(56) References Cited

U.S. PATENT DOCUMENTS

| | | | | | |
|---|---|---|---|---|---|
| 297,219 | A | * | 4/1884 | Anthony | 108/43 |
| 544,684 | A | | 8/1895 | Parker | |
| 2,420,673 | A | | 5/1947 | Monrad | |
| D164,269 | S | | 8/1951 | Whittier | |
| 3,215,453 | A | | 11/1965 | Malcom, Jr. | |
| 3,232,685 | A | | 2/1966 | Wilstein et al. | |
| 3,407,757 | A | * | 10/1968 | Warner | 108/43 |
| 3,791,314 | A | * | 2/1974 | Berretta | 108/43 |
| 3,828,696 | A | | 8/1974 | Locfridge | |
| 4,046,294 | A | * | 9/1977 | Morin | 108/43 |
| 4,819,568 | A | * | 4/1989 | Coffrin | 108/43 |
| 4,852,498 | A | * | 8/1989 | Judd | 108/43 |
| 4,926,758 | A | * | 5/1990 | Lilly et al. | 108/43 |
| 4,998,185 | A | | 3/1991 | DeNigris, Jr. | |
| 5,127,339 | A | * | 7/1992 | Hood, Jr. | 108/43 |
| 5,176,274 | A | * | 1/1993 | Jenkins | 108/43 |
| 5,388,530 | A | | 2/1995 | Jacobus | |
| 5,615,817 | A | | 4/1997 | Shevers, Jr. | |
| 6,116,165 | A | * | 9/2000 | Kadesky | 108/43 |
| 6,496,360 | B1 | * | 12/2002 | Cordes et al. | 108/43 |
| 2001/0000901 | A1 | | 5/2001 | Kambouris et al. | |

FOREIGN PATENT DOCUMENTS

GB 2140290 * 11/1984

OTHER PUBLICATIONS

About the Ultimate Kneeboard, [Retrieved Sep. 29, 2001] Retrieved From Internet, URL:www.harder–aviation.rom/kneeboards.

(List continued on next page.)

*Primary Examiner*—José V. Chen
(74) *Attorney, Agent, or Firm*—David O. Simmons

(57) ABSTRACT

A multi-leaf organizer according to at least one embodiment of the disclosures herein includes a first leaf having a first surface and a second surface. A second leaf is disposed adjacent to a first longitudinal edge of the first leaf. A first hinge assembly is attached between the first leaf and the second leaf for enabling the second leaf to be moved between a respective self-supported open position and a respective closed position with respect to the first leaf. The first hinge assembly retains the second leaf in the respective self-supported open position and the second leaf defines a support surface in a substantially side-by-side relationship with the second surface of the first leaf when the second leaf is in the respective self-supported open position. A document binding device is mounted on the second surface of the first leaf adjacent to a second longitudinal edge of the first leaf. A third leaf is disposed adjacent to a second longitudinal edge of the first leaf. A second hinge assembly is attached between the first leaf and the third leaf for enabling the third leaf to be moved between a respective self-supported open position and a respective closed position with respect to the first leaf. The second hinge assembly retains the third leaf in the respective self-supported open position and the third leaf defines a support surface in a substantially side-by-side relationship with the second surface of the first leaf when the third leaf is in the respective self-supported open position. A base is mounted on the first surface of the first leaf and include an arched portion for engaging a portion of an appendage of a body.

17 Claims, 9 Drawing Sheets

OTHER PUBLICATIONS

Saunders Office Products, [Retrieved Sep. 29, 2001] Retrieved From Internet, URL: www.saunders–usa.com.
Sporty's Pilot Shop: Browsing Nav–Data Kneeboard, [Retrieved Sep. 29, 2001] Retrieved from Internet, URL: www.sportys.com/acb.
ASA–Catalog Pilot, [Retrieved Sep. 29, 2001] Retrieved From Internet, URL: www.asazfly.com/cat_supl.htm.
Jeppesen Pilot Accessories, [Retrieved Sep. 29, 2001] Retrieved From Internet, URL: www.jeppesen.com/store.
Kneeboards, [Retrieved Sep. 29, 2001] Retrieved From Internet, URL: www.cencal.com/kneeboard.html.
Pilot Kneeboards, [Retrieved Sep. 29, 2001] Retrieved From Internet, URL: www.lcflight.com/body_kneebrd.html.

Flyboys: Kneeboards, [Retrieved Sep. 29, 2001] Retrieved From Internet, URL: www.flyboys.com/store/kneeboards.html.

Sporty's Mail Order Catalog, pp. 36–37, Kneeboard Products, Charts/Flight Planning Section, May–Aug. 2001 Edition.

* cited by examiner

MULTI-LEAF ORGANIZER

FIELD OF THE DISCLOSURE

The disclosures herein relate generally to organizers and more particularly to a multi-leaf organizer with surfaces for retaining items such as a writing pad or documentation capable of being folded between a closed, compact position and a self-supported open position.

BACKGROUND OF THE DISCLOSURE

Organizers of various types are known. These various types of organizers allow an organizer user to secure items such as checklists, schedules, address/phone directories, reference materials and other similar types of documentation within the organizer. Many such organizers also provide one or more substantially rigid support surfaces for enabling notations to be made on a document or sheet of paper with a writing instrument. Although most organizers are used on a conventional surface, such as a desk or table, many can also be held by the user or rested on the user's knee when a conventional surface is not available to support the unit. Some relevant suppliers of commercially available organizers include Saunders Office Products (www.saunders-usa.com), Day-Timer (www.daytimer.com) and Mead Corporation (www.mead.com).

One specific type of organizer is an organizer intended to be mounted on and/or attached to an appendage of a person, article or other type of body, in cases where a desk or other conventional surface is not available or desirable to support the unit. These types of organizers may include some type of structure for enabling the organizer to be mounted on and, in some cases, securely attached to an appendage of a body. An aviator kneeboard is an example of such an organizer capable of being mounted on and/or attached to the appendage of an aviator's body. In this example, a structural element having an arched surface may be used to engage the aviator's thigh and a retaining strap may be used to secure the organizer to the aviator's thigh. Various types of aviator kneeboards are commercially available from sources such as Aviation Supplies & Academics Incorporated (www.asa2fly.com), Jeppesen Sanderson Incorporated (www.jeppesen.com), Sportsman's Market Incorporated (www.sportys.com), Cencal Aviation Products (www.cencal.com), and LC Flight Products (www.lcflight.com), Flyboys (www.flyboys.com) and Harper Aviation (www.harper-aviation.com). Some of the commercially available kneeboard designs are derived from conventional office products such as clipboards, personal organizers and forms holders.

An organizer having a conventional construction suffers from one or more drawbacks. A multi-leaf organizer having a conventional construction is referred to herein as a conventional organizer. Examples of drawbacks associated with conventional organizers include but are not limited to one or more of the following limitations. A first limitation is associated with the difficulty of providing a horizontal working surface without directly supporting each of its leaves. A second limitation is associated with the difficulty of ensuring easy access and rapid closure of the organizer leaves. A third limitation is associated with the inability to flip through the contents of a ring-type binder and leave a third leaf unobstructed for viewing or jotting notes. A fourth limitation is associated with the difficulty of expanding or contracting the overall size of the unit to accommodate space available and functions required. A fifth limitation is associated with the cumbersome nature of holding, carrying or storing the unit. A sixth limitation is associated with the cumbersome use of the unit on a desktop when a base is employed. A seventh limitation is associated with the inability to add advanced organizer functionality to a standard ring-type binder.

Accordingly, a multi-leaf organizer capable of at least partially overcoming these drawbacks is useful.

DETAILED DESCRIPTION

Figure 1:
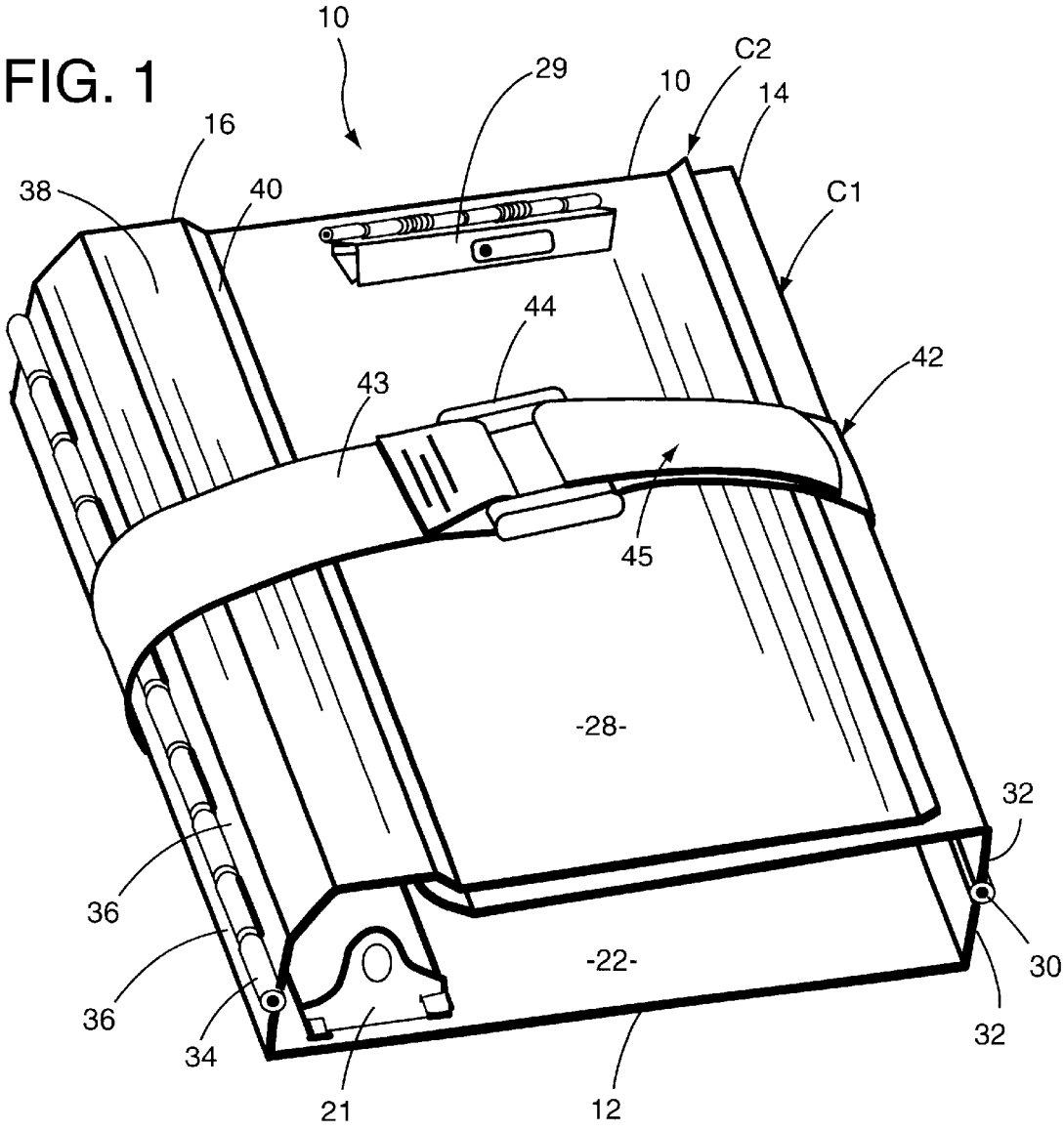
FIG. 1 is a front perspective view depicting a multi-leaf organizer in accordance with a first embodiment of the disclosures herein, wherein the multi-leaf organizer includes a first leaf having a second leaf and a third leaf pivotally attached thereto.

FIGS. 1 through 9 depict various aspects of a multi-leaf organizer according to various embodiments of the disclosures made herein. Such various aspects of a multi-leaf organizer provide advantageous results, capabilities and characteristics relative to a conventional organizer. The organizer described herein at least partially overcomes the limitations of conventional organizers as outlined previously. Specific examples of advantages over conventional organizers disclosed herein include but are not limited to one or more of the following advantages. A first advantage is associated with the ease of providing a horizontal working surface without directly supporting each of its leaves. A second advantage is associated with the ease of ensuring easy access and rapid closure of the organizer leaves. A third advantage is associated with the ability to flip through the contents of a ring-type binder and leave a third leaf unobstructed for viewing or jotting notes. A fourth advantage is associated with the ease of expanding or contracting the overall size of the unit to accommodate space available and functions required. A fifth advantage is associated with the ease of holding, carrying or storing the unit. A sixth advantage is associated with the ease of using the unit on a desktop when a base is employed. A seventh advantage is associated with the ability to add advanced organizer functionality to a standard ring-type binder.

With respect to the first advantage disclosed above, organizer according to at least one embodiment of the disclosures herein are capable of providing a horizontal and rigid work surface comprising any or all of its leaves while only requiring the user to support one of its leaves, such as the first leaf disclosed herein. This is accomplished through the use of hinges on the first leaf, which are folded back onto themselves in the self-supported open position, limiting the range of motion for the second and third leaves. One example of this approach provides a rigid, near horizontal work surface for all three leaves, while only requiring support under the first leaf. This is especially important when a desk or other conventional surface is not available to support the entire organizer and an appendage of a person, article or other type of body must be used to hold or support the organizer instead.

With respect to the second advantage disclosed above, organizers according to at least one embodiment of the disclosures herein have the ability to be rapidly closed or opened due to the hinged approach above. This aspect may be critical in the example of a pilot using an organizer as a kneeboard where space in the cockpit is at a premium and control items may be blocked by an organizer in its fully open position. In this case, the pilot may need to quickly flip one of the organizer leaves closed or out of the way to access a switch, lever or other aircraft control item otherwise obscured by the leaf, then quickly return it to the fully open position for further use.

With respect to the third advantage disclosed above, organizers according to at least one embodiment of the disclosures herein have the potential for derivative designs involving locations of various organizer functions that may not have been practical previously. For example, one such organizer can be configured such that a ring-type binder could be used to flip through documents on two adjacent leaves, providing the user unobstructed access to a writing pad on another leaf. In cases where the organizer is to be used on a pilot's knee for example, conventional organizers require the writing pad to be supported directly by the knee, which would require the binder contents to obscure the writing pad, or the user may forgo the use of a standard binder for managing documents.

With respect to the fourth advantage disclosed above, organizers according to at least one embodiment of the disclosures herein are capable of providing ease of contracting or expanding the size of the organizer to accommodate the space available. For example, one such organizer can be used in its fully open position as described in the previous paragraph. It can also be completely closed and used as a clipboard. It can be partially closed, so that the outer cover is used as a clipboard, while the writing pad folded out for jotting notes or holding additional documents. In another embodiment, the unit could be partially opened revealing the ring-type binder and its contents, but the writing pad could be closed, under the ring-type binder contents.

With respect to the fifth advantage disclosed above, organizers according to at least one embodiment of the disclosures herein are capable of providing ease of holding, carrying and storing the unit. For example, one such organizer possesses a contour around the ring-type binder and a corresponding contour in the arch of the base, which makes the unit easy to grip with one hand for use or for carrying. The compact design in this embodiment made possible, in part through the use of the contour around the ring-type binder makes the unit compact when closed relative to the documents intended to be stored therein. The strap, which may be used in this embodiment to secure the organizer to ones' thigh, can also be used to secure the unit in the closed position for easy storage in a flight bag for example.

With respect to the sixth advantage disclosed above, organizers according to at least one embodiment of the disclosures herein are capable of providing the ease of using the unit on a desktop when a base is employed. For example, one such organizer possesses a base with an arch intended to engage the thigh of the user when a desk or other conventional surface is not available or convenient to support the unit during use. While a base with an arch is not uncommon for this type of application, typical designs which employ a base with an arch can be quite unstable when used on a desktop or other conventional surface because the base is usually only slightly wider than the arch to allow for the base material to be attached by outward flange to the unit.

The approach taken in this example makes a typical organizer with a base, top heavy and slightly pointed on the bottom, which can cut into a desktop surface if not protected. This approach extends the base outward near the extents of the first leaf and utilizes an inward flange to attach the base to the first leaf. This provides a wider, more stable platform for the unit if used on a desk. Additionally, because the rivets attaching the base to the first leaf are now concealed, there is less chance of inadvertent contact with other objects such as a human hand. The flat surface created at the bottom of the base can also be covered in foam to ensure that the unit does not mar the desktop surface when used in that mode.

With respect to the seventh advantage disclosed above, organizers according to at least one embodiment of the disclosures herein have the ability to add advanced organizer functionality to a standard ring-type binder assembly. For example, a standard ring-type binder assembly may be inserted into an adapter of sorts, which might add to the binder, a base to engage one's thigh and a leaf, which might include a writing pad. This would compliment the standard ring-type binder assembly, which would already possess the binder ring, cover and possibly already contain personal documents. A user could attach one such adapter to a personal binder when these advanced features were needed.

Referring to FIGS. 1 through 5, a multi-leaf organizer 10 according to an embodiment of the disclosures herein is depicted. The multi-leaf organizer 10 includes first leaf 12, a second leaf 14 and a third leaf 16. The first leaf 12, the second leaf 14 and the third leaf 16 are substantially rigid. The second leaf 14 and the third leaf 16 are disposed adjacent to a first longitudinal edge and a second longitudinal edge, respectively, of the first leaf 12. Forming the leaves 12, 14, 16 from a material such as a sheet of aluminum having a thickness of between about 0.020" and 0.080" is an example of providing leaves that are substantially rigid. Leaves may be made from other substantially rigid materials such as extruded plastic or made from rigid materials and covered with other materials such as leather, rubber or synthetics.

A base 18 is mounted on a first surface 20 of the first leaf 12. A document binding device 21 is attached to the second surface 22 of the first leaf 12. The base 18 includes an arched portion 23 for engaging a portion of an appendage of a body. A compliant material 24, such as for example foam, is attached to the arched portion 22 of the base 18. A commercially available multi-ring binding device assembly having a standardized ring format is an example of the document binding device 21.

As depicted in FIGS. 2–5, the base 18 is attached to the first leaf 12 through inward facing flanges 25 attached via fastening members 27. Inward facing is defined herein to mean that the flanges 25 each extend toward the arched portion 22 of the base 18. Rivets, threaded fasteners and the like are examples of the fastening members 27. The implementation of the inboard facing flanges 25 enables the base 18 to be wider for a given width of the first leaf 12 relative to a base with outward facing flanges. Furthermore, the fastening members 27 are concealed under the base, limiting the potential for being snagged on items and being damaged.

Figure 2:
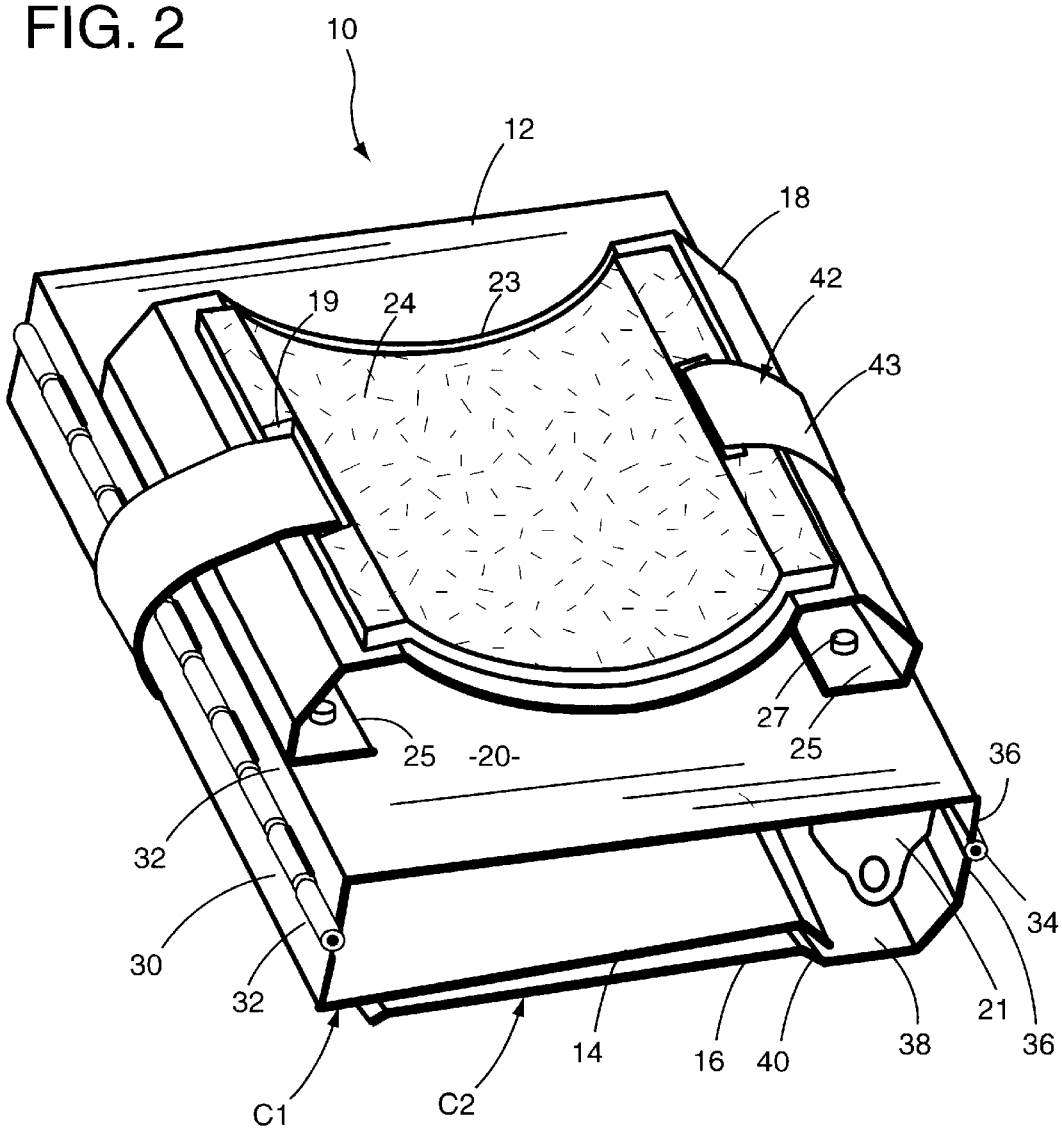
FIG. 2 is a rear perspective view of the multi-leaf organizer depicted in FIG. 1.
Figure 3:
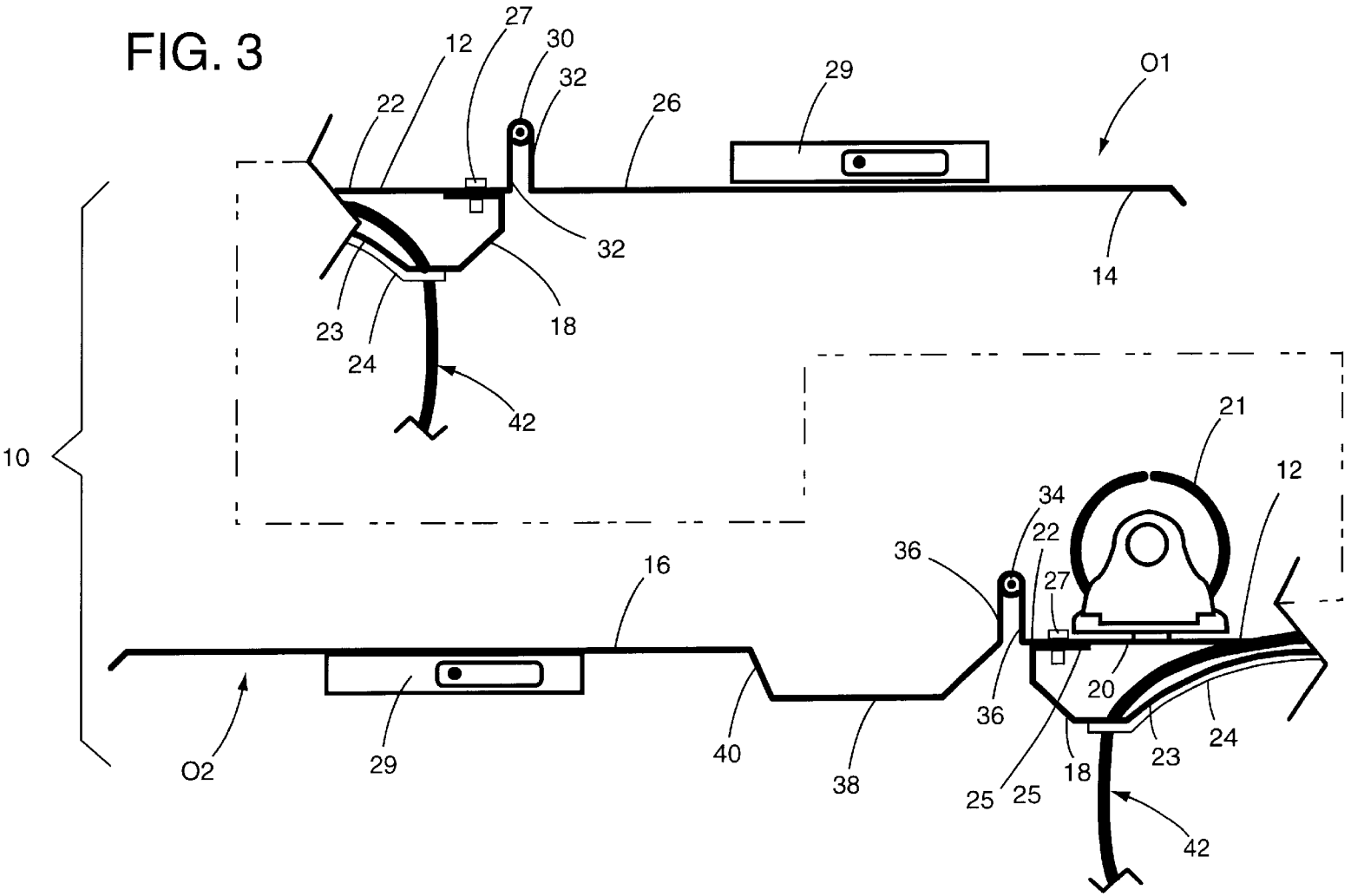
FIG. 3 is an end view of the multi-leaf organizer depicted in FIG. 1, wherein the second leaf and the third leaf are each in an open position with respect to the first leaf.
Figure 4:
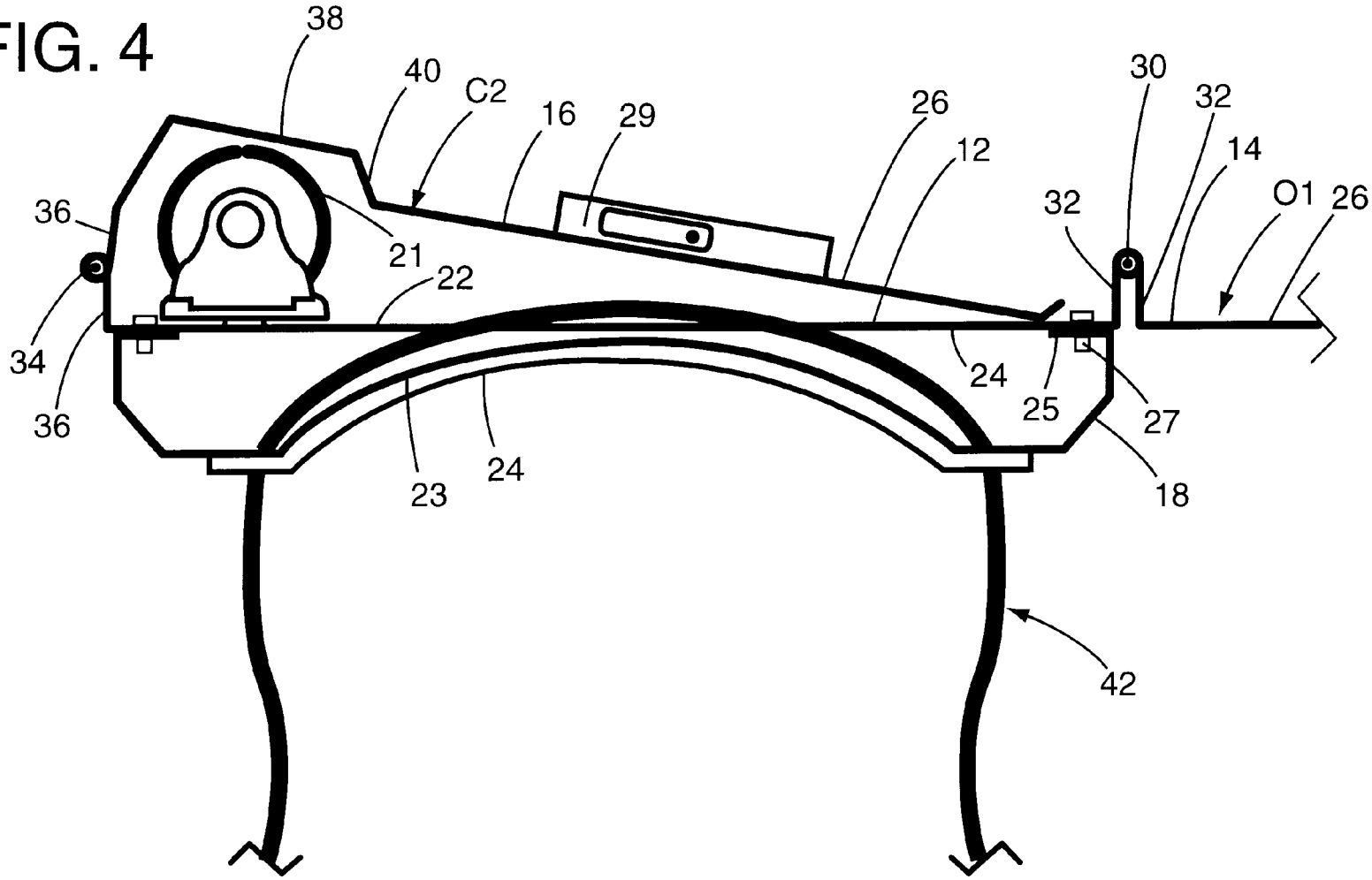
FIG. 4 is an end view of the multi-leaf organizer depicted in FIG. 1, wherein the second leaf is in an open position with respect to the first leaf and the third leaf is in a closed position with respect to the first leaf.
Figure 5:
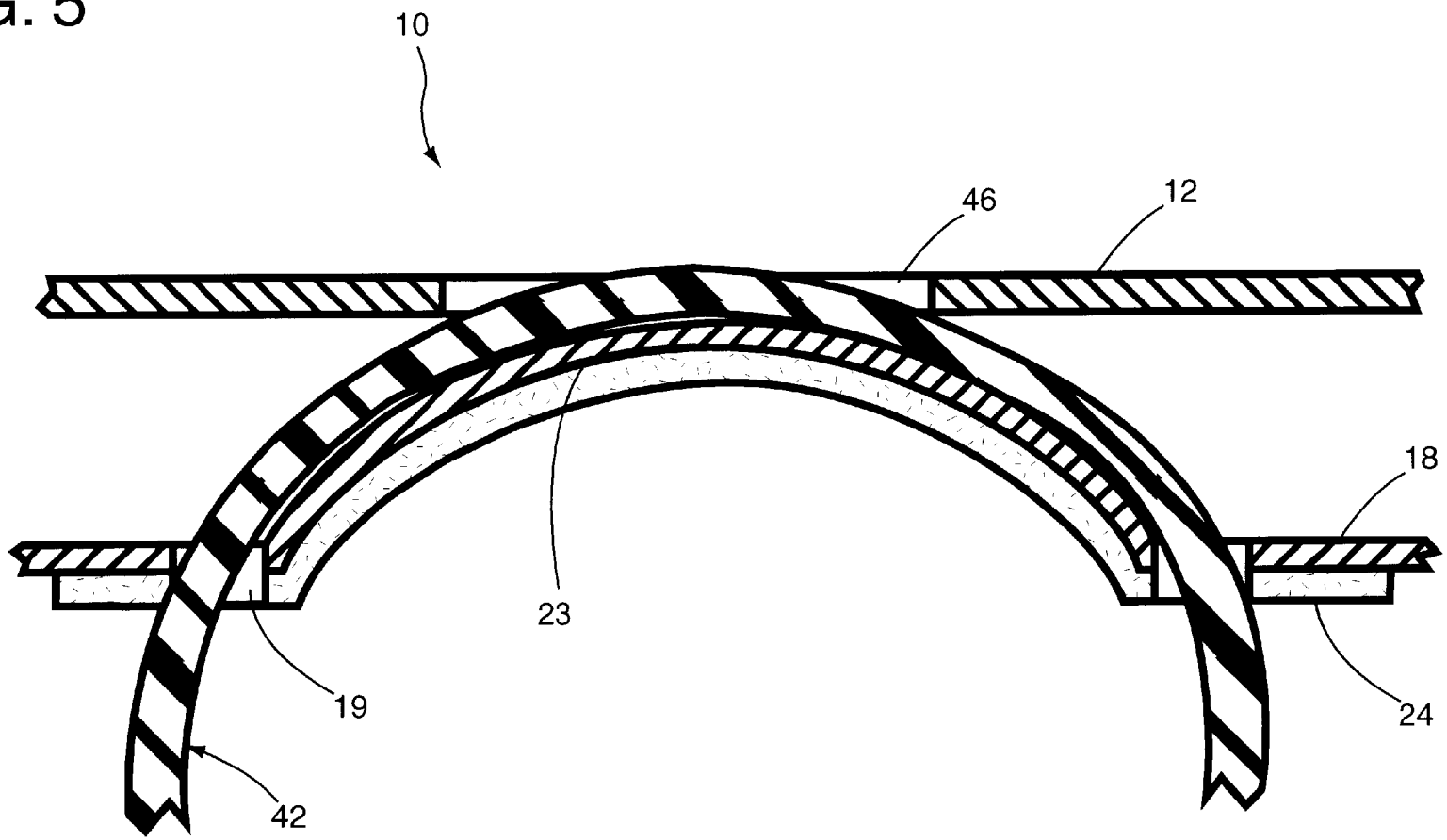
FIG. 5 is a fragmented cross-sectional view depicting an aperture in the first leaf of the multi-leaf.

The second leaf 14 is attached to the first leaf 12 in a manner allowing the second leaf 14 to be moved between a self-supported open position O1, FIGS. 3 and 4, and a closed position C1, FIGS. 1 and 2, with respect to the first leaf 12. The third leaf 16 is attached to the first leaf 12 in a manner allowing the third leaf 16 to be moved between a self-supported open position O2, FIG. 3, and a closed position C2, FIGS. 1, 2 and 4, with respect to the first leaf 12.

The term self-supported open position as used herein refers to an open position in which further movement of a leaf away from the respective closed position is precluded and in which support for the leaf is obtained through an adjacent leaf, rather than by a surface or structural element directly underneath (i.e. the leaf is self-supported in the open position). It should be understood that when a leaf is in its respective self-supported open position, the leaf is not necessarily locked in place in the open position.

The closed position C1 of the second leaf 14 and the closed position C2 of the third leaf may fall within a range of closed positions. For example, the closed position C2 of the third leaf 16 may be slightly different when the second leaf 14 is in the closed position C1 or in the open position O1. Similarly, the closed position C1 of the second leaf 14 and the closed position C2 of the third leaf 16 may be slightly different depending on the quantity of documents (i.e. a stack of documents) attached to the document binding device 21.

The second leaf 14 includes a support surface 26 capable of retaining items such as a writing pad or documentation 26, FIGS. 3 and 4, and the third leaf 16 includes a support surface 28 capable of retaining items such as a writing pad or documentation, FIGS. 1, 3 and 4. It is contemplated and disclosed herein that the second leaf 14 is advantageously capable of being positioned such that the support surface 26 of the second leaf 14 is in a substantially side-by-side relationship with the second surface 22 of the first leaf 12 when the second leaf 14 is in the self-supported open position O1. It is also contemplated and disclosed herein that the third leaf 16 is advantageously capable of being positioned such that the surface for retaining items such as a writing pad or documentation 28 of the third leaf 16 is accessible when the third leaf 16 is in the closed position C2. Document retaining devices 29 are mounted on each the surface 26 of the second leaf 14 and on the surface 28 of the third leaf 16. A spring-loaded clamp is an example of the document retaining device 29.

The second leaf 14 is positioned between the first leaf 12 and the third leaf 16 when the second leaf 14 is in its closed position C1 and the third leaf 16 is in its closed position C2. The second leaf 14 configured and/or attached in a manner such that the second leaf 14 is positioned substantially adjacent to the first leaf 12 when the second leaf 14 and the third leaf 16 are each in their respective closed positions (C1, C2).

A first hinge assembly 30 is attached between the first leaf 12 and the second leaf 14. In at least one embodiment of the first hinge assembly 30, the first hinge assembly 30 is capable of enabling the second leaf 14 to be moved between the self-supported open position O1 and the closed position C1. It is contemplated and disclosed herein that the first hinge assembly 30 may be constructed and/or installed in a manner such that the first hinge assembly 30 is capable of retaining the second leaf 14 in the self-supported open position O1 in essentially the same plane or a substantially parallel plane as the first leaf 12. A multi-part metal hinge made from discrete metallic components is one example of the first hinge assembly 30. It is contemplated and disclosed herein that the first hinge assembly 30 may also be fabricated using known multi-durometer extrusion techniques.

The first leaf 12 and the second leaf 14 each include a first flange 32 (also referred to as a first pair of flanges 32). The first leaf 12 and the second leaf 14 are pivotally attached to each other adjacent to the first pair of flanges 32. In at least one embodiment of the first pair of flanges 32, the first pair of flanges 32 is capable of retaining the second leaf 14 in the self-supported open position O1.

A second hinge assembly 34 is attached between the first leaf 12 and the third leaf 16. In one embodiment of the second hinge assembly 34, the second hinge assembly 34 is capable of enabling the third leaf 16 to be moved between the self-supported open position O2 and the closed position C2. It is contemplated and disclosed herein that the second hinge assembly 34 may be constructed and/or installed in a manner such that the second hinge assembly 34 is capable of retaining the third leaf 14 in the self-supported open position O2.

One advantageous aspect of organizers associated with at least one embodiment of the disclosures herein is the relationship of the second leaf 14 and the third leaf 16 with respect to the base 18. Specifically, the second leaf 14 and/or third leaf 16 (or portions of the hinges thereof) extend into engagement with the base 18 when in their respective self-supported open positions (O1 and O2, respectively). Accordingly, the second leaf 14 and the third leaf 16 are capable of providing a stable platform for writing or managing documents thereon.

The first leaf 12 and the third leaf 16 each include a second flange 36 (also referred to as a second pair of flanges 36). The first leaf 12 and the third leaf 16 are pivotally attached to each other adjacent to the second pair of flanges 36. In at least one embodiment of the second pair of flanges 36, the second pair of flanges 36 is capable of retaining the third leaf 16 in the self-supported open position O2.

The third leaf 16 includes a trough-like portion 38. At least a portion of the document binding device is positioned within the trough-like portion of the third leaf 16 when the third leaf 16 is in the closed position C2. The trough-like portion 38 of the third leaf 16 is positioned between the surface for retaining items such as a writing pad or documentation 28 of the third leaf 16 and the second hinge assembly 34. A step 40 is defined between the trough-like portion 38 and the surface for retaining items such as a writing pad or documentation 28 of the third leaf 16.

A retaining strap 42 extends through apertures 19 in the base 18. The retaining strap 42 is capable of being secured around an appendage of a body for securing the base 18 in engagement with the appendage. The retaining strap 42 is also capable of being fastened around the leaf assembly for securing the second leaf 14 and the third leaf 16 in their respective closed positions C1 and C2.

The retaining strap 42 includes a strap 43 (e.g. a braided polymeric strap) having a buckle 44 at a first end thereof and a wrappable hook and loop segment 45 at a second end thereof. It is contemplated and disclosed herein that the step 40 defined between the trough-like portion 38 and the support surface 28 of the third leaf 16 provides a relief for receiving the buckle 43, thus contributing to a low-profile or the multi-leaf organizer 10. It is also contemplated and disclosed herein that a quick-release buckle could also be used for this purpose. Various embodiments of the retaining strap 42 are commercially available from Velcro USA.

The arched portion 23 of the base 18 is essentially abutting the first surface 20 of the first leaf 12. The first leaf 12 includes an aperture 46 adjacent to the arched portion 23 of the base 18. A portion of the retaining strap 42 extends at least partially through the aperture 44, FIG. 5.

Although not shown, it is contemplated and disclosed herein that the multi-leaf organizer according to one embodiment of the disclosures herein includes a lighting device capable of illuminating at least a portion of one or more surfaces of the various leaves of the multi-leaf organizer. Positioning a battery case of the lighting device between the first leaf 12 and the base 18 is one example of a mounting arrangement of the lighting device. In at least one embodiment of the lighting device, the lighting device includes an articulating portion capable of being manually positioned relative to one or more surfaces of the various leaves of the multi-leaf organizer. A multi-member arm and a flexible pipe are examples of the articulating portion of the lighting device.

Figure 6:
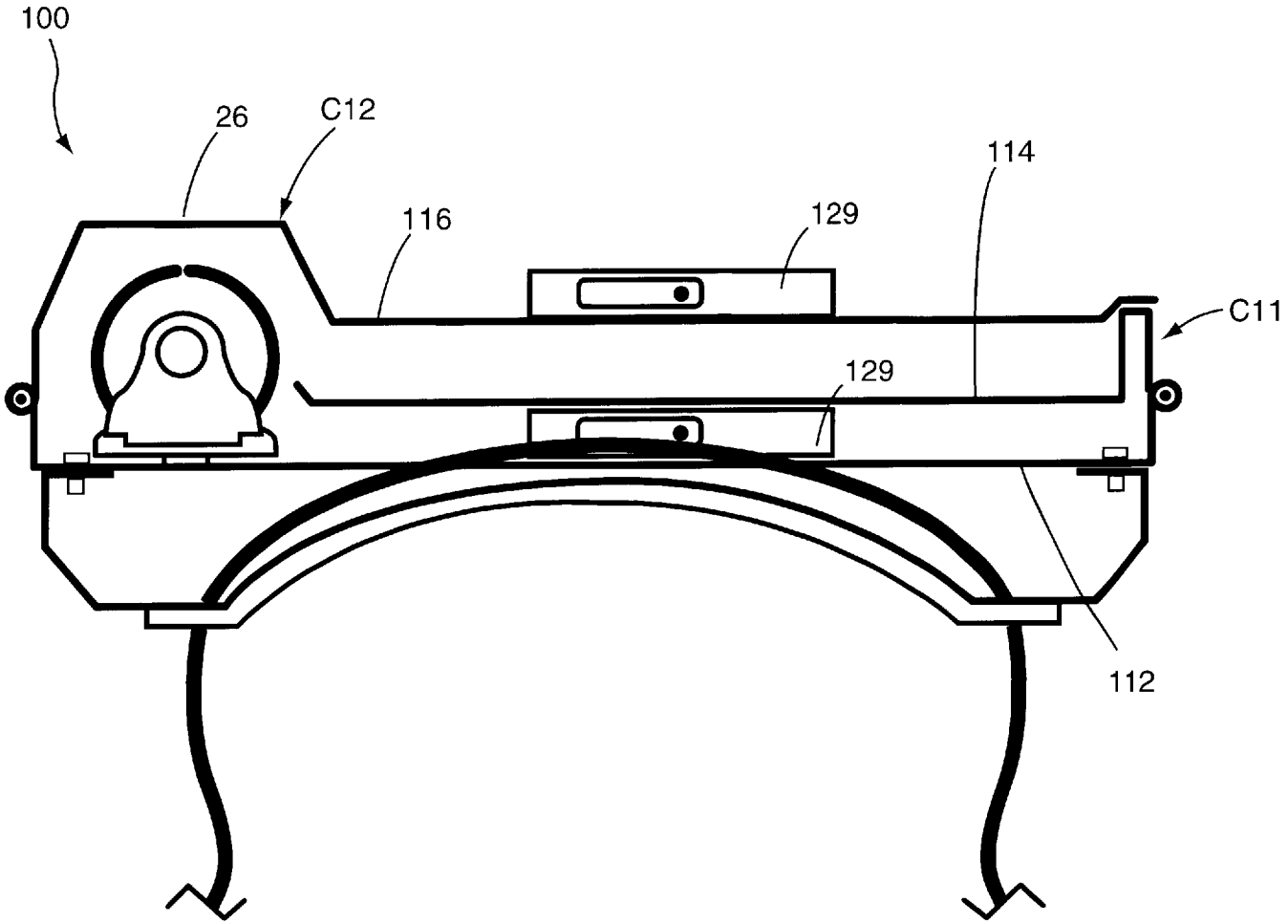
FIG. 6 is a end view depicting a multi-leaf organizer in accordance with another embodiment of the disclosures herein, wherein a first leaf of the multi-leaf organizer is substantially ajacent to a second leaf of the multi-leaf organizer.

In accordance with another embodiment of the disclosures herein, a multi-leaf organizer 100 is depicted in FIG. 6. The organizer 100 includes a first leaf 112, a second leaf 114 and a third leaf 116. The first leaf 112, the second leaf 114 and the third leaf 116 are each substantially rigid. The second leaf 114 and the third leaf 116 are each pivotally attached to the first leaf 112. The second leaf 114 is substantially adjacent to the first leaf 112 when the second leaf 114 is in its closed position C11. Accordingly, a stack of bound documents are capable of being positioned between the second leaf 114 and the third leaf 116 when the second leaf is in its closed position C11 and the third leaf 116 is in its closed position C12.

Figure 7:
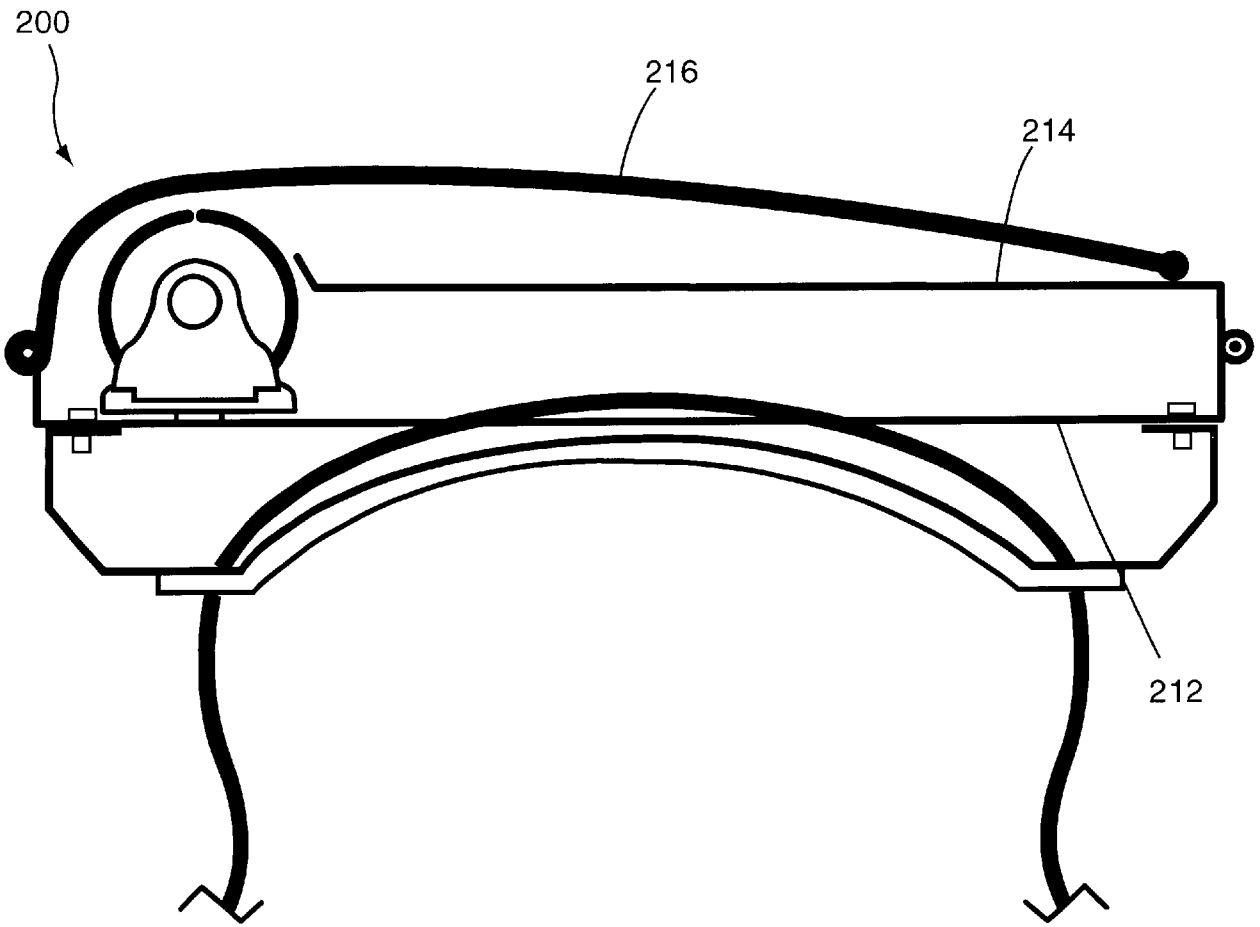
FIG. 7 is an end view depicting a multi-leaf organizer in accordance with another embodiment of the disclosures herein, wherein a first leaf and a second leaf are both substantially rigid and a third leaf is substantially compliant.

In accordance with another embodiment of the disclosures herein, a multi-leaf organizer 200 is depicted in FIG. 7. The organizer 200 includes a first leaf 212, a second leaf 214 and a third leaf 216. The second leaf 214 and the third leaf 216 are each pivotally attached to the first leaf 212. The first leaf 212 and the second leaf 214 are each substantially rigid. The third leaf 216 is substantially pliable. Cordura brand nylon available from Dupont, leather, and other compliant materials are examples of materials from which the third leaf 216 may be made.

Figure 8:
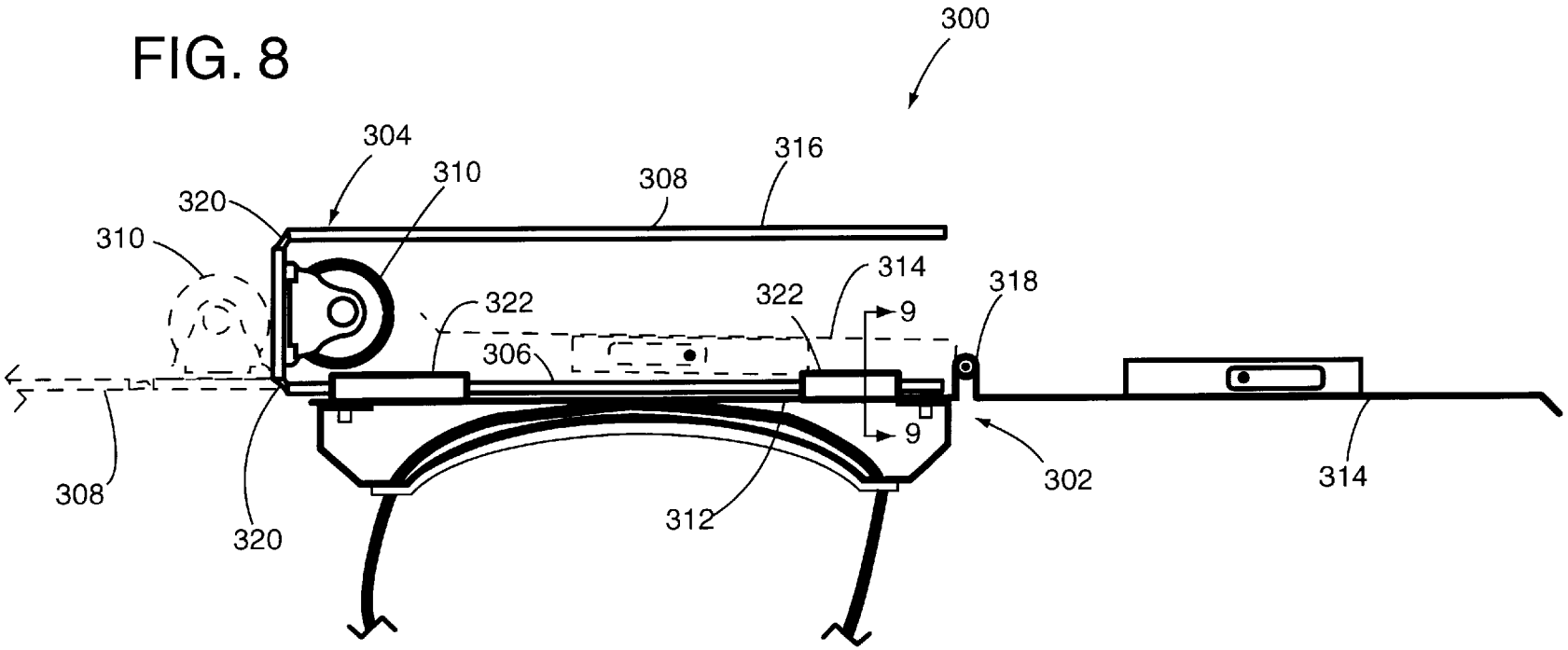
FIG. 8 is an end view depicting a multi-leaf organizer in accordance with another embodiment of the disclosures herein, wherein a first leaf and a second leaf are both substantially rigid and wherein functionality of a third leaf is and a document binding device are provided via mounting of a discrete document binding assembly on the first leaf.
Figure 9:
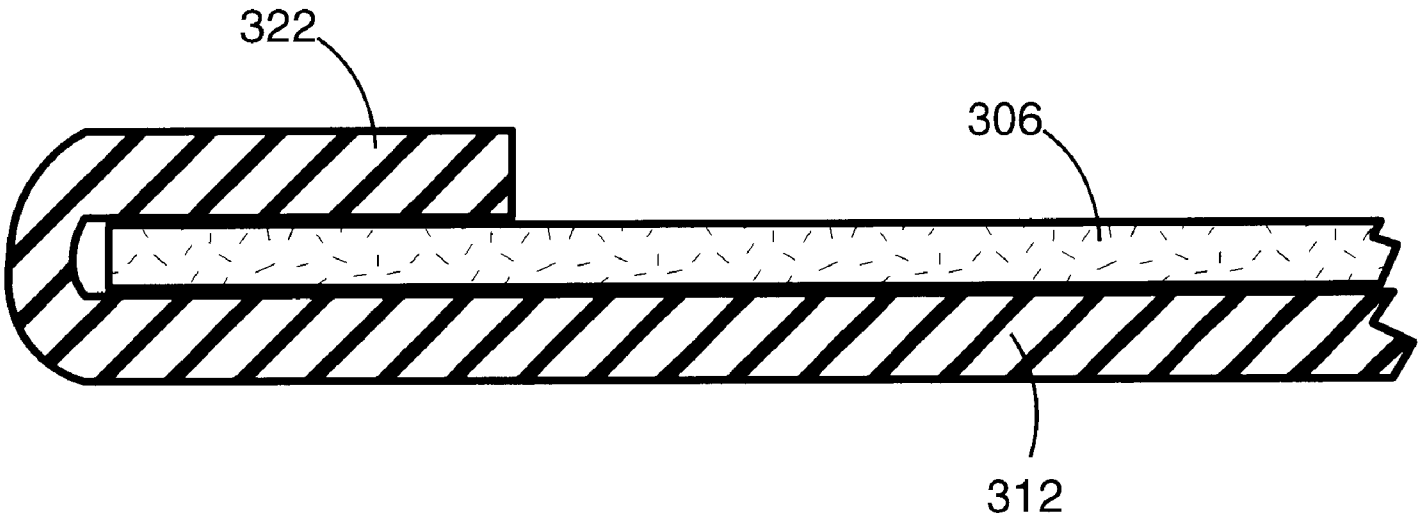
FIG. 9 a cross-sectional view taken along the line 9—9 in FIG. 8.

A multi-leaf organizer 300 in accordance with another embodiment of the disclosures herein, is depicted in FIGS. 8 and 9. The organizer 300 includes an organizer adapter 302 and a standard or proprietary document binding assembly 304. The document binding assembly 304 includes a first cover 306, a second cover 308 and a document binding device 310. The organizer adapter 302 includes a first leaf 312, a second leaf 314 and a means for enabling a standard or proprietary document binding assembly 304 to be mounted on the organizer adapter 302. The first leaf 312 and the second leaf 314 are each substantially rigid.

By mounting the document binding assembly 304 on the organizer adapter 302, a third leaf 316 is defined by the second cover 308. The third leaf 316 may be rigid or substantially pliable depending on the type of document binding assembly used. A commercially available ring-type binder assembly is one example of the document binding assembly 304. An Airway Manual commercially available from Jeppesen Sanderson Inc is another example of the document binding assembly 304.

The second leaf 314 and the third leaf 316 are each pivotally attached to the first leaf 312 via a first hinge 318 and a second hinge 320, respectively. A plurality of engagement members 322 are attached to the first leaf 312 and are capable of retaining the first cover 306 of the document binding assembly 304. The plurality of engagement members 322 is an example of the means for enabling the document binding assembly 304 to be mounted on the multi-leaf organizer adapter 302.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

I claim:

1. A multi-leaf organizer, comprising:

a first leaf including a first surface and a second surface;

a second leaf;

a first hinge assembly attached between and extending generally parallel with a first longitudinal edge of the first leaf and a first longitudinal edge of the second leaf for enabling the second leaf to be moved between a self-supported open position and a respective closed position with respect to the first leaf, wherein the first hinge assembly retains the second leaf in the self-supported open position and wherein the second leaf defines a support surface in a substantially side-by-side relationship with the second surface of the first leaf when the second leaf is in the self-supported open position; and a multi-ring document binding device mounted on the second surface of the first leaf adjacent to a second longitudinal edge of the first leaf, wherein a longitudinal axis of the multi-ring document binding device extends generally parallel with the first and second longitudinal edges of the first leaf.

2. The multi-leaf organizer of claim 1 wherein the first hinge assembly includes:

a first flange extending approximately perpendicular to the first surface of the first leaf; and a second flange extending approximately perpendicular to the support surface defined by the second leaf.

3. The multi-leaf organizer of claim 2 wherein:

the first flange is integrally formed with the first leaf; and the second flange is integrally formed with the second leaf.

4. The multi-leaf organizer of claim 1, further comprising:

a third leaf disposed adjacent to a second longitudinal edge of the first leaf; and a second hinge assembly attached between the first leaf and the third leaf for enabling the third leaf to be moved between a respective self-supported open position and a respective closed position with respect to the first leaf, wherein the second hinge assembly retains the third leaf in the respective self-supported open position and wherein the third leaf defines a support surface in a substantially side-by-side relationship with the second surface of the first leaf when the third leaf is in the respective self-supported open position.

5. The multi-leaf organizer of claim 4 wherein the second leaf is positioned between the first leaf and the third leaf when the second leaf and the third leaf are each in their respective closed positions.

6. The multi-leaf organizer of claim 5 wherein the second leaf is positioned substantially adjacent to the first leaf when the second leaf and the third leaf are each in their respective closed positions.

7. The multi-leaf organizer of claim 5 wherein the second leaf is positioned substantially adjacent to the third leaf when the second leaf and the third leaf are in their respective closed positions.

8. The multi-leaf organizer of claim 4 wherein the second hinge assembly includes:

a first flange extending approximately perpendicular to the first surface of the first leaf; and a second flange extending approximately perpendicular to the support surface defined by the third leaf.

9. The multi-leaf organizer of claim 8 wherein:

the first flange is integrally formed with the first leaf; and the second flange is integrally formed with the third leaf.

10. The multi-leaf organizer of claim 4 wherein the third leaf includes a trough-like portion in which at least a portion of the document binding device is positioned when the third leaf is in the respective closed position.

11. The multi-leaf organizer of claim 10 wherein:

the trough-like portion of the third leaf is positioned between the support surface of the third leaf and the second hinge assembly; and a step is defined between the trough-like portion and the support surface of the third leaf.

12. The multi-leaf organizer of claim 1, further comprising:

a base mounted on the first surface of the first leaf, wherein the base includes an arched portion for engaging a portion of an appendage of a body.

13. The multi-leaf organizer of claim 12, further comprising:

a retaining strap extending through the base, wherein the retaining strap is capable of being secured around the appendage of the body for securing the base in engagement with the appendage of the body.

14. The multi-leaf organizer of claim 12 wherein:

the arched portion of the base is essentially abutting the first surface of the first leaf;

the first leaf includes an aperture therein adjacent to the arched portion of the base; and a portion of the retaining strap extends at least partially through the aperture.

15. A multi-leaf organizer, comprising:

a first leaf including a first surface and a second surface;

a second leaf;

a first hinge assembly attached between and extending generally parallel with a first longitudinal edge of the first leaf and a first longitudinal edge of the second leaf for enabling the second leaf to be moved between a respective self-supported open position and a respective closed position with respect to the first leaf, wherein the first hinge assembly retains the second leaf in the respective self-supported open position and wherein the second leaf defines a support surface in a substantially side-by-side relationship with the second surface of the first leaf when the second leaf is in the respective self-supported open position;

a multi-ring document binding device mounted on the second surface of the first leaf adjacent to a second longitudinal edge of the first leaf, wherein a longitudinal axis of the multi-ring document binding device extends generally parallel with the first and second longitudinal edges of the first leaf;

a third leaf;

a second hinge assembly attached between and extending generally parallel with the first longitudinal edge of the first leaf and a first longitudinal edge of the third leaf for enabling the third leaf to be moved between a respective self-supported open position and a respective closed position with respect to the first leaf, wherein the second hinge assembly retains the third leaf in the respective self-supported open position and wherein the third leaf defines a support surface in a substantially side-by-side relationship with the second surface of the first leaf when the third leaf is in the respective self-supported open position; and a base mounted on the first surface of the first leaf, wherein the base includes an arched portion for engaging a portion of an appendage of a body.

16. The multi-leaf organizer of claim 15 wherein the third leaf includes a trough-like portion in which at least a portion of the document binding device is positioned when the third leaf is in the closed position.

17. The multi-leaf organizer of claim 16 wherein:

the trough-like portion of the third leaf is positioned between the support surface of the third leaf and the second hinge assembly; and a step is defined between the trough-like portion and the support surface of the third leaf.

* * * * *